US009069331B2

(12) United States Patent
Fujii

(10) Patent No.: US 9,069,331 B2
(45) Date of Patent: Jun. 30, 2015

(54) SUPPORT UNIT AND IMAGE FORMING APPARATUS

(71) Applicant: KYOCERA Document Solutions Inc., Osaka (JP)

(72) Inventor: Hirokazu Fujii, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/095,782

(22) Filed: Dec. 3, 2013

(65) Prior Publication Data

US 2014/0153953 A1 Jun. 5, 2014

(30) Foreign Application Priority Data

Dec. 5, 2012 (JP) ..... 2012-266268

(51) Int. Cl.
*G03G 21/16* (2006.01)
*G03G 21/18* (2006.01)

(52) U.S. Cl.
CPC ..... *G03G 21/1832* (2013.01); *G03G 21/1633* (2013.01); *G03G 21/1652* (2013.01)

(58) Field of Classification Search
CPC ..... G03G 21/1832; G03G 21/1633; G03G 21/1652
USPC ..... 399/90, 110, 111, 116, 117, 119, 114, 399/107
See application file for complete search history.

(56) References Cited

U.S. PATENT DOCUMENTS

| | | | | |
|---|---|---|---|---|
| 7,742,717 | B2 * | 6/2010 | Kim | 399/90 |
| 8,121,516 | B2 * | 2/2012 | Wu et al. | 399/111 |
| 2006/0204276 | A1 | 9/2006 | Takuwa | |
| 2008/0080894 | A1 | 4/2008 | Takuwa | |
| 2008/0226337 | A1 * | 9/2008 | Han et al. | 399/111 |
| 2008/0317500 | A1 * | 12/2008 | Lee et al. | 399/114 |
| 2011/0091222 | A1 * | 4/2011 | Kim et al. | 399/90 X |
| 2013/0121719 | A1 * | 5/2013 | Park et al. | 399/90 |
| 2014/0205316 | A1 * | 7/2014 | Lee et al. | 399/110 |

FOREIGN PATENT DOCUMENTS

JP 2006-251345 9/2006

* cited by examiner

*Primary Examiner* — Sophia S Chen
(74) *Attorney, Agent, or Firm* — Knobbe, Martens, Olson & Bear LLP

(57) ABSTRACT

A support unit that supports a member to be supported is inserted in an apparatus main body thus to be mounted therein. The support unit includes a wall portion, a connector unit, and a cover member. The wall portion is provided on an upstream end portion of the support unit in the direction in which the support unit is inserted. The connector unit is provided on the wall portion for electrical connection between the apparatus main body and the support unit. The cover member is pivotably supported by a bearing portion provided on the wall portion, so as to pivot between a first position in which the connector unit is exposed so as to allow an operator to grasp the cover member, and a second position in which the connector unit is concealed.

6 Claims, 14 Drawing Sheets

SUPPORT UNIT AND IMAGE FORMING APPARATUS

INCORPORATION BY REFERENCE

This application claims priority to Japanese Patent Application No. 2012-266268 filed on Dec. 5, 2012, the entire contents of which are incorporated by reference herein.

BACKGROUND

The present disclosure relates to a support unit that supports a member to be supported, the support unit being removably mounted in an apparatus main body, and to an image forming apparatus incorporated with the support unit.

In an image forming apparatus, a toner image is formed on a photoconductor drum by a developing device, and the toner image is transferred onto a sheet in a transfer unit. The image forming apparatus further includes a fixing unit. The sheet on which the toner image has been transferred undergoes a fixing process by the fixing unit and is then discharged. Some of image forming apparatus thus configured to form an image on a sheet includes a support unit that supports a predetermined member, the support unit being removably mounted in the apparatus main body.

The support units thus far developed include a drum unit that supports the photoconductor drum, a developer unit that supports the developing device, and a process unit that integrally supports the photoconductor drum and the developing device. Such support units include a connector unit for electrical connection. When the support unit is mounted in the apparatus main body the connector of the apparatus main body and the connector unit of the support unit are electrically connected, so that driving power and control signals are supplied to the support unit from the apparatus main body. Some of such support units include a cover member that conceals the connector unit.

Here, it is preferable that the support unit includes a grasp portion that facilitates an operator to mount or remove the support unit in and from the apparatus main body. For example, the grasp portion is provided on a cover member that opens and closes the apparatus main body.

SUMMARY

In an aspect, the disclosure proposes improvement of the foregoing technique.

The disclosure provides a support unit configured to support a member to be supported and be inserted in an apparatus main body thus to be mounted therein.

The support unit includes a wall portion, a connector unit, and a cover member.

The wall portion is provided on an upstream end portion of the support unit in the direction in which the support unit is inserted.

The connector unit is provided on the wall portion for electrical connection between the apparatus main body and the support unit.

The cover member is pivotably supported by a bearing portion provided on the wall portion, so as to pivot between a first position in which the connector unit is exposed so as to allow an operator to grasp the cover member, and a second position in which the connector unit is concealed.

In another aspect, the disclosure provides an image forming apparatus including the apparatus main body, an image forming unit, and the support unit.

The image forming unit is located inside the apparatus main body and serves to form an image on a recording medium.

DETAILED DESCRIPTION

Figure 1:
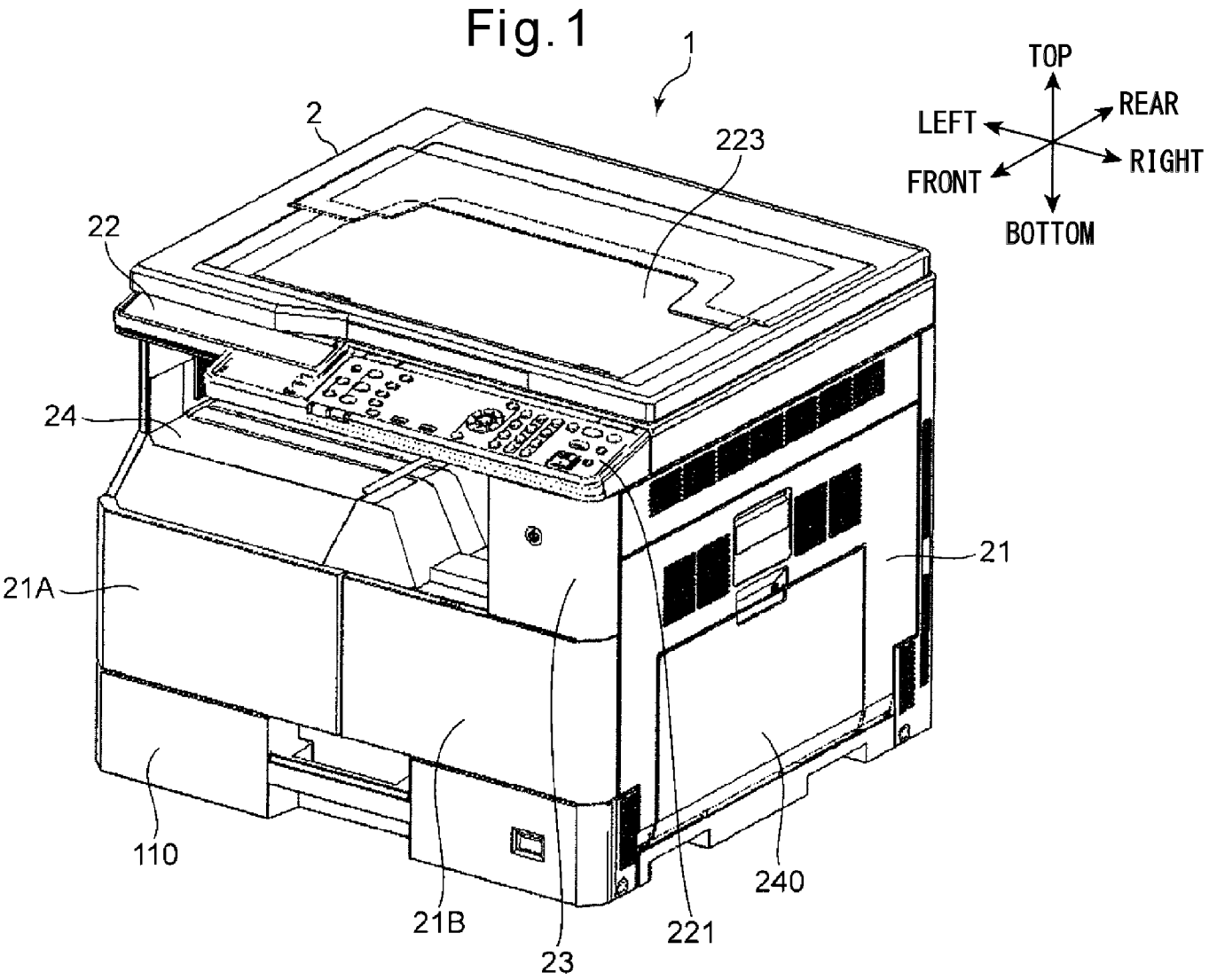
FIG. 1 is a perspective view showing an image forming apparatus according to an embodiment of the present disclosure.
Figure 2:
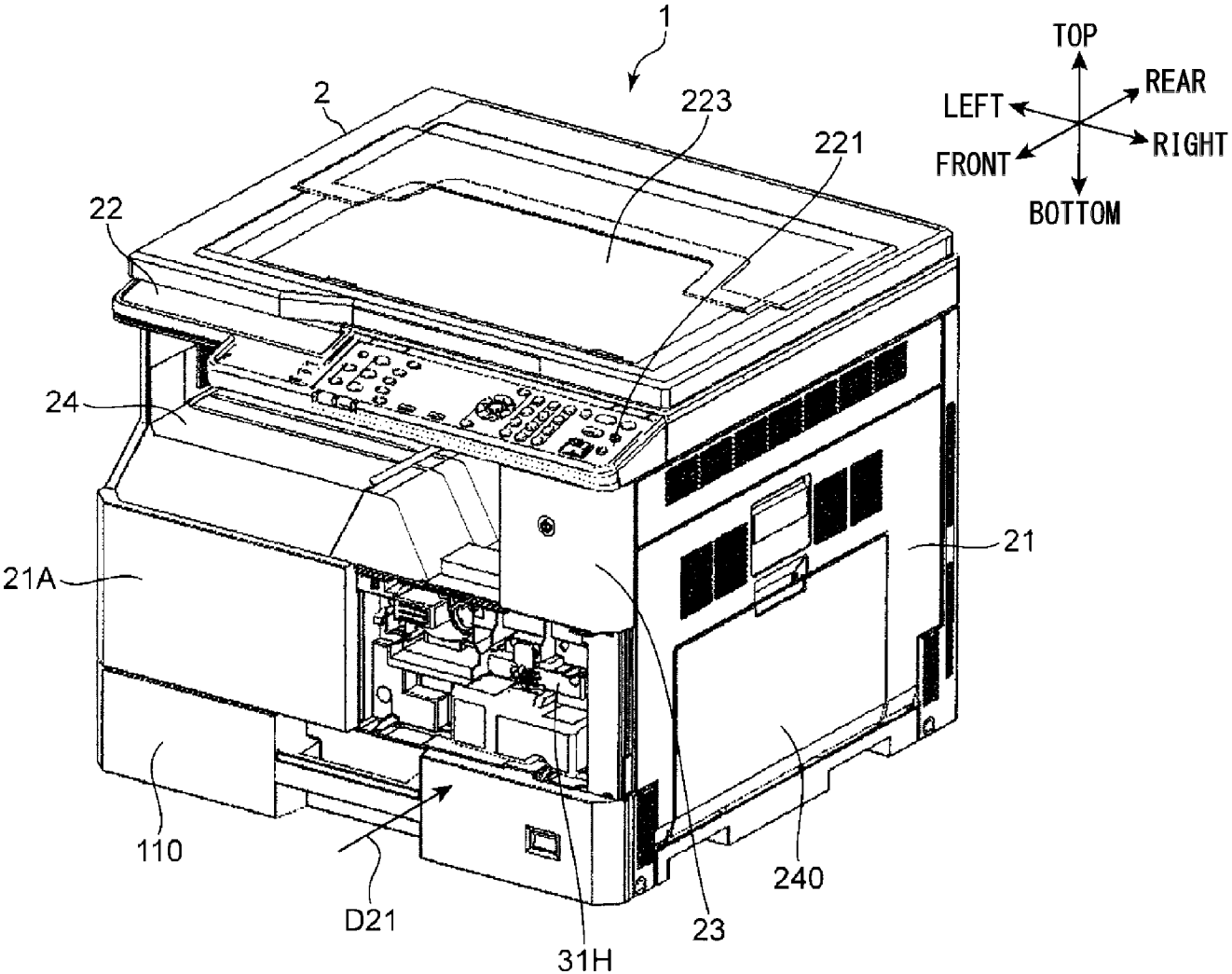
FIG. 2 is a perspective view showing the image forming apparatus according to the embodiment of the disclosure, from which the right cover is removed.
Figure 3:
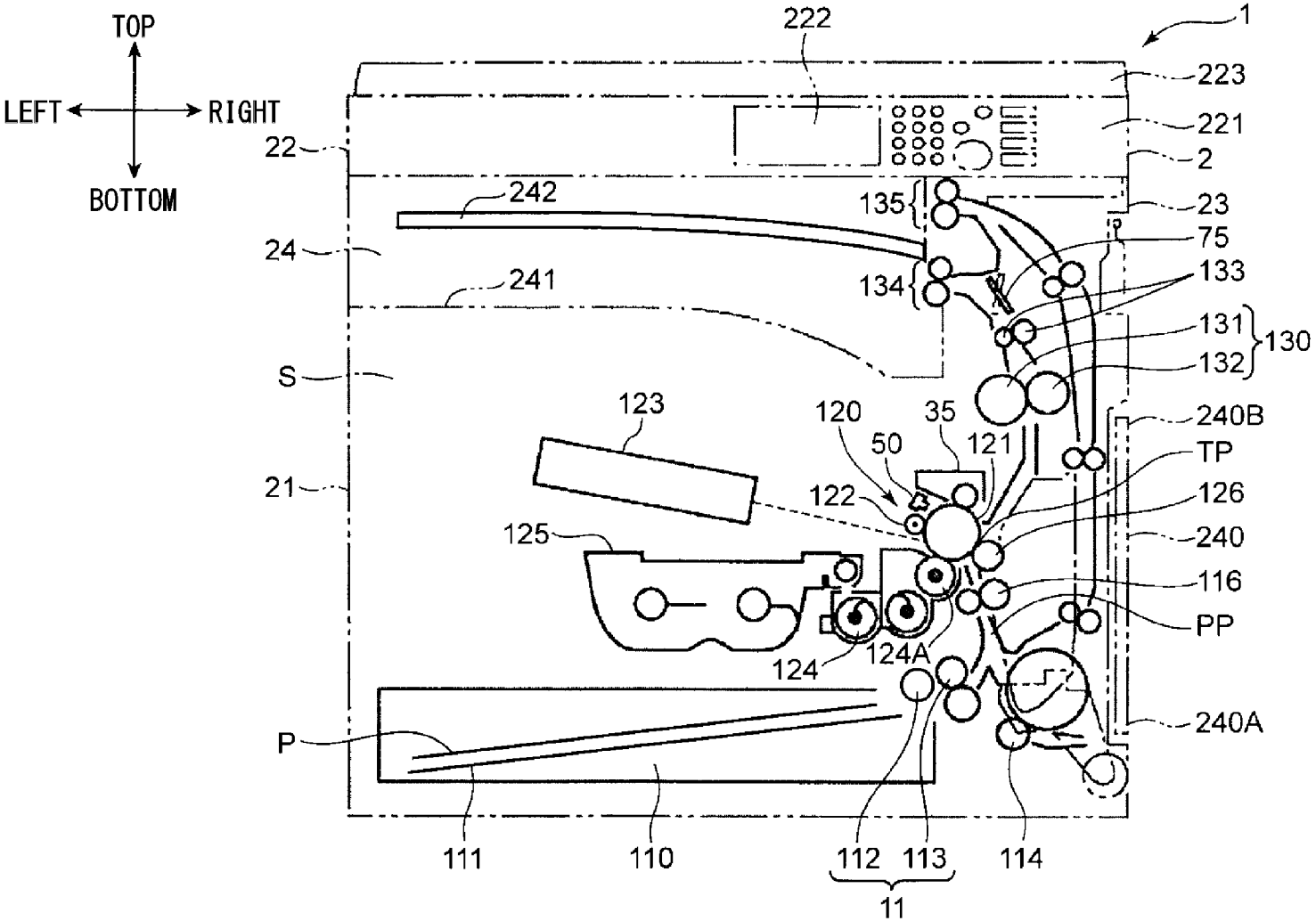
FIG. 3 is a cross-sectional view showing an internal structure of the image forming apparatus according to the embodiment of the disclosure.

Hereafter, an embodiment of the disclosure will be described referring to the drawings. FIGS. 1 and 2 are perspective views showing an appearance of an image forming apparatus 1 according to the embodiment of the disclosure. FIG. 2 illustrates a state in which a right cover 21B (described later) is removed. FIG. 3 is a cross-sectional view showing an internal structure of the image forming apparatus 1. Although the image forming apparatus 1 shown in FIGS. 1 to 3 is what is known as a multifunction machine, in other embodiments the image forming apparatus may be a different apparatus configured to form a toner image on a sheet, such as a color multifunction machine, a color printer, or a facsimile machine. It is to be noted that directional expressions such as up, down, front, back, left, and right employed in the following passages are merely intended to clarify the description, and in no way limit the principle of the image forming apparatus. In addition, the term "sheet" referred to in the following description encompasses a copy paper, a coated paper, an OHP sheet, a cardboard, a postcard, a tracing paper, a sheet material that undergoes an image forming process, and a sheet material that undergoes any process other than the image forming process.

The image forming apparatus 1 includes a main casing 2 having a generally rectangular block shape. The main casing 2 includes a lower casing 21 (apparatus main body) having a generally rectangular block shape, an upper casing 22 having a generally rectangular block shape and located above the lower casing 21, and an intermediate casing 23 connecting between the lower casing 21 and the upper casing 22. The intermediate casing 23 is disposed to extend along a right end portion and a rear end portion of the main casing 2. The sheet that has undergone the printing process is discharged to an output space 24 surrounded by the lower casing 21, the upper casing 22, and the intermediate casing 23. More specifically, the sheet is discharged to a discharge unit 241 located on the upper face of the lower casing 21, and an output tray 242 located above the discharge unit 241 (see FIG. 3) in this embodiment.

An operation panel 221 located in a forward portion of the upper casing 22 includes, for example, an LCD touch panel 222. The operation panel 221 enables a user to input information about the image forming process. For example, the user can input the number of sheets to be printed or printing density, through the LCD touch panel 222. The upper casing 22 includes therein devices for reading an image on a source document, and electronic circuits that control the overall operation of the image forming apparatus 1.

A top cover 223 located on top of the upper casing 22 serves to fix the source document. The top cover 223 is attached to the upper casing 22 so as to pivot up and downward. The user makes the top cover 223 pivot upward, and places the source document on the upper casing 22. Then the user manipulates the operation panel 221 to cause the devices inside the upper casing 22 to read the image on the source document.

The lower casing 21 includes a left cover 21A and a right cover 21B. The left cover 21A and the right cover 21B constitute a part of a front wall portion of the lower casing 21. The left cover 21A is located under the output space 24 and on the left side. The right cover 21B is located under the output space 24 and the intermediate casing 23. The left cover 21A and the right cover 21B are cover members removably attached to the lower casing 21. As shown in FIG. 2, a drum unit 31H (described later) is inserted in the lower casing 21 in a direction indicated by an arrow D21, when the right cover 21B is removed from the lower casing 21.

A manual feed tray 240 is provided on the right face of the lower casing 21. Referring to FIG. 3, the manual feed tray 240 is configured such that the upper end 240B pivots up and downward about the lower end 240A. When the manual feed tray 240 is made to pivot downward to as to stick out to the right of the lower casing 21, the user can place the sheet on the manual feed tray 240. The sheet on the manual feed tray 240 is drawn into the lower casing 21 and undergoes the image forming process, and then discharged to the output space 24, according to the instruction inputted by the user through the operation panel 221. In addition, the lower casing 21 includes an internal space S in which devices cited below are included.

In the image forming apparatus 1, a cassette 110, a paper feed unit 11, a second feed roller 114, a resist roller pair 116, and an image forming unit 120 are provided in the internal space S. The paper feed unit 11 includes a pickup roller 112 and a first feed roller 113. The paper feed unit 11 delivers the sheet P to a sheet transport path PP. The sheet transport path PP serves to guide the sheet from the paper feed unit 11 through the resist roller pair 116, so as to pass a transfer position TP provided in the image forming unit 120.

The cassette 110 stores therein the sheet P. The cassette 110 can be drawn out from the lower casing 21 in the forward direction. The sheet P in the cassette 110 is delivered upward inside the lower casing 21. Then the sheet P undergoes the image forming process in the lower casing 21 and is discharged to the output space 24, according to the instruction inputted by the user through the operation panel 221. The cassette 110 includes a lifting plate 111 that supports the sheet P. The lifting plate 111 inclined so as to lift upward the leading edge of the sheet P.

The pickup roller 112 is located above the leading edge of the sheet P lifted up by the lifting plate 111. The sheet P is drawn out from the cassette 110 when the pickup roller 112 rotates.

The first feed roller 113 is located downstream of the pickup roller 112 in the sheet transport direction. The first feed roller 113 delivers the sheet P further downstream in the sheet transport direction. The second feed roller 114 is located on the inner side of the lower end 240A of the manual feed tray 240. The second feed roller 114 delivers the sheet P on the manual feed tray 240 into the lower casing 21. The user can selectively use either of the sheet P stored in the cassette 110 or the sheet P placed on the manual feed tray 240.

The resist roller pair 116 defines the position of the sheet in the direction orthogonal to the sheet transport direction. Accordingly, the position of the image on the sheet P is adjusted. The resist roller pair 116 includes a nip portion between the pair of rollers. The resist roller pair 116 transports the sheet P to the image forming unit 120 in accordance with the timing at which the toner image is transferred onto the sheet P in the image forming unit 120. The resist roller pair 116 also serves to correct skewing of the sheet P.

The image forming unit 120 includes a photoconductor drum 121 (image carrier), a charger 122, an exposure unit 123, a developing device 124, a toner container 125, a transfer roller 126, a cleaning unit 35, and a static eliminator 50. The photoconductor drum 121, the charger 122, the cleaning unit 35, and the static eliminator 50 are collectively disposed in the drum unit 31H to be subsequently described.

The photoconductor drum 121 has a cylindrical outer shape. A static latent image is formed on the outer circumferential surface of the photoconductor drum 121, and the toner image corresponding to the static latent image is retained thereon.

A predetermined voltage is applied to the charger 122, so that the circumferential surface of the photoconductor drum 121 is generally uniformly charged. The exposure unit 123 emits a laser beam onto the circumferential surface of the photoconductor drum 121 charged by the charger 122. The laser beam is emitted according to image data outputted from an external device such as a personal computer (not shown), communicably connected to the image forming apparatus 1. The static latent image corresponding to the image data is thus formed on the circumferential surface of the photoconductor drum 121.

The developing device 124 supplies a toner to the circumferential surface of the photoconductor drum 121 on which the static latent image has been formed. The toner container 125 supplies the toner to the developing device 124, sequentially or when necessary. When the developing device 124 supplies the toner to the photoconductor drum 121, the static latent image formed on the circumferential surface of the photoconductor drum 121 is developed (visualized). The toner image is thus formed on the circumferential surface of the photoconductor drum 121. The developing device 124 includes a developing roller 124A that carries the toner on the circumferential surface thereof. The developing roller 124A is located at the developing position so as to oppose the photoconductor drum 121. The developing roller 124A is driven to rotate so as to supply the toner to the photoconductor drum 121.

The transfer roller 126 is located at the transfer position TP so as to oppose the circumferential surface of the photoconductor drum 121. The transfer roller 126 is driven to rotate in the same direction as the photoconductor drum 121, at the transfer position TP. The transfer position TP is where the toner image formed on the circumferential surface of the photoconductor drum 121 is transferred onto the sheet P.

The cleaning unit 35 removes the toner remaining on the circumferential surface of the photoconductor drum 121 after the toner image is transferred onto the sheet P. The static eliminator 50 emits a predetermined static eliminating beam onto the photoconductor drum 121, the circumferential surface of which has been cleaned by the cleaning unit 35. As a result, the potential on the circumferential surface of the photoconductor drum 121 is leveled off.

After being cleaned by the cleaning unit 35 and undergoing the static elimination by the static eliminator 50, the circumferential surface of the photoconductor drum 121 again passes under the charger 122, thus to be uniformly charged. Thereafter, the formation of the toner image is performed anew.

The image forming apparatus 1 further includes a fixing unit 130 that fixes the toner image on the sheet P, located downstream of the image forming unit 120 in the sheet transport direction. The fixing unit 130 includes a heating roller 131 that melts the toner on the sheet P, and a pressure roller 132 that tightly presses the sheet P against the heating roller 131. The toner image is fixed on the sheet P, once the sheet P passes between the heating roller 131 and the pressure roller 132.

Still further, the image forming apparatus 1 includes a transport roller pair 133 located downstream of the fixing unit 130, a switching unit 75 located downstream of the transport roller pair 133, a lower discharge roller 134, and an upper discharge roller 135. The transport roller pair 133 delivers the sheet P on which the image has been fixed by the fixing unit 130, to the downstream side in the sheet transport direction. The switching unit 75 serves to switch the transport direction of the sheet P, at a position downstream of the transport roller pair 133 in the sheet transport direction. The lower discharge roller 134 is located on the left of the switching unit 75, and discharges the sheet P delivered from the transport roller pair 133 to the discharge unit 241. The upper discharge roller 135 is located above the lower discharge roller 134, and discharges the sheet P delivered from the transport roller pair 133 to the output tray 242 mounted above the discharge unit 241.

Figure 4:
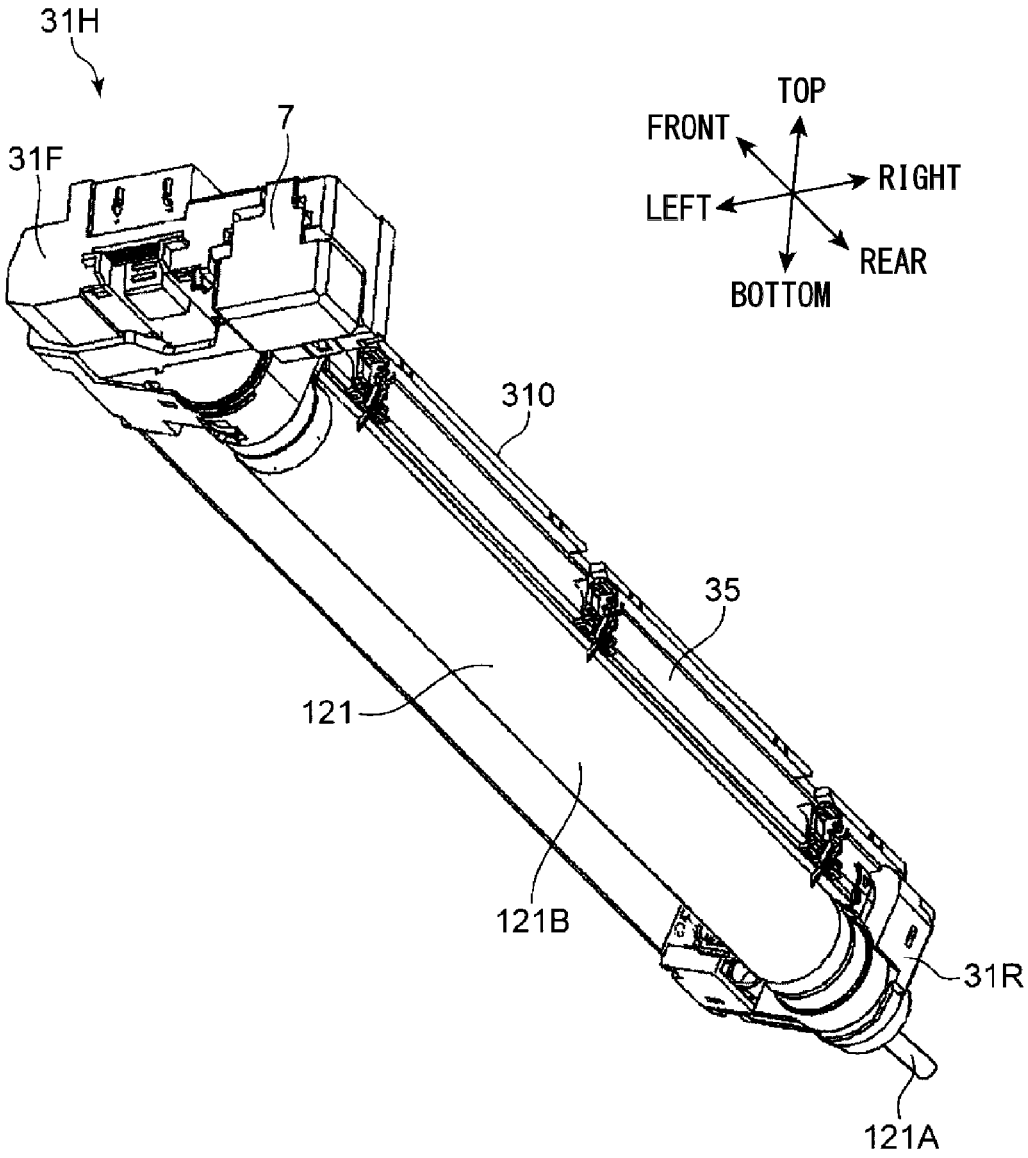
FIG. 4 is a perspective view showing a drum unit according to the embodiment of the disclosure.
Figure 5:
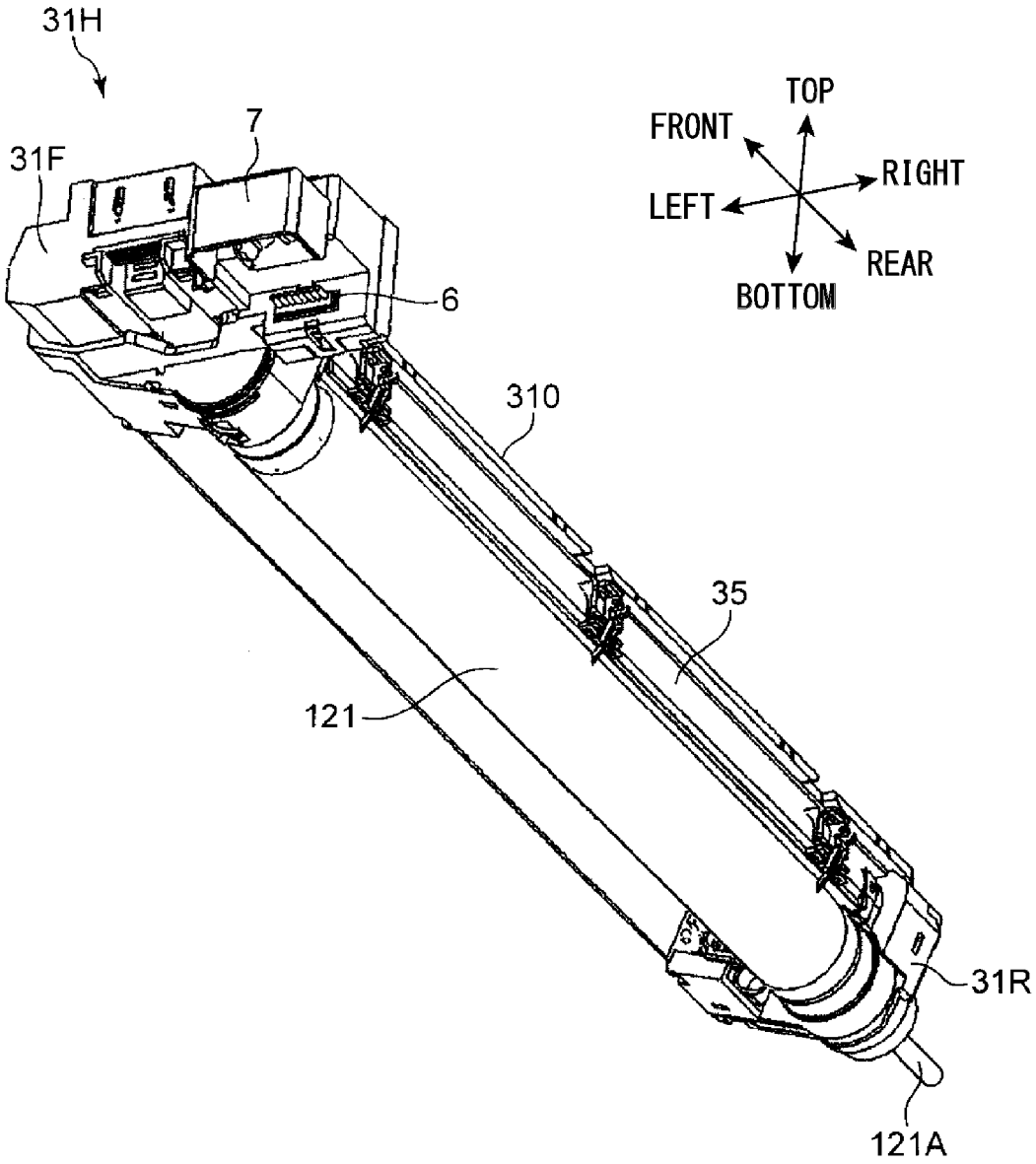
FIG. 5 is another perspective view showing the drum unit according to the embodiment of the disclosure.
Figure 6:
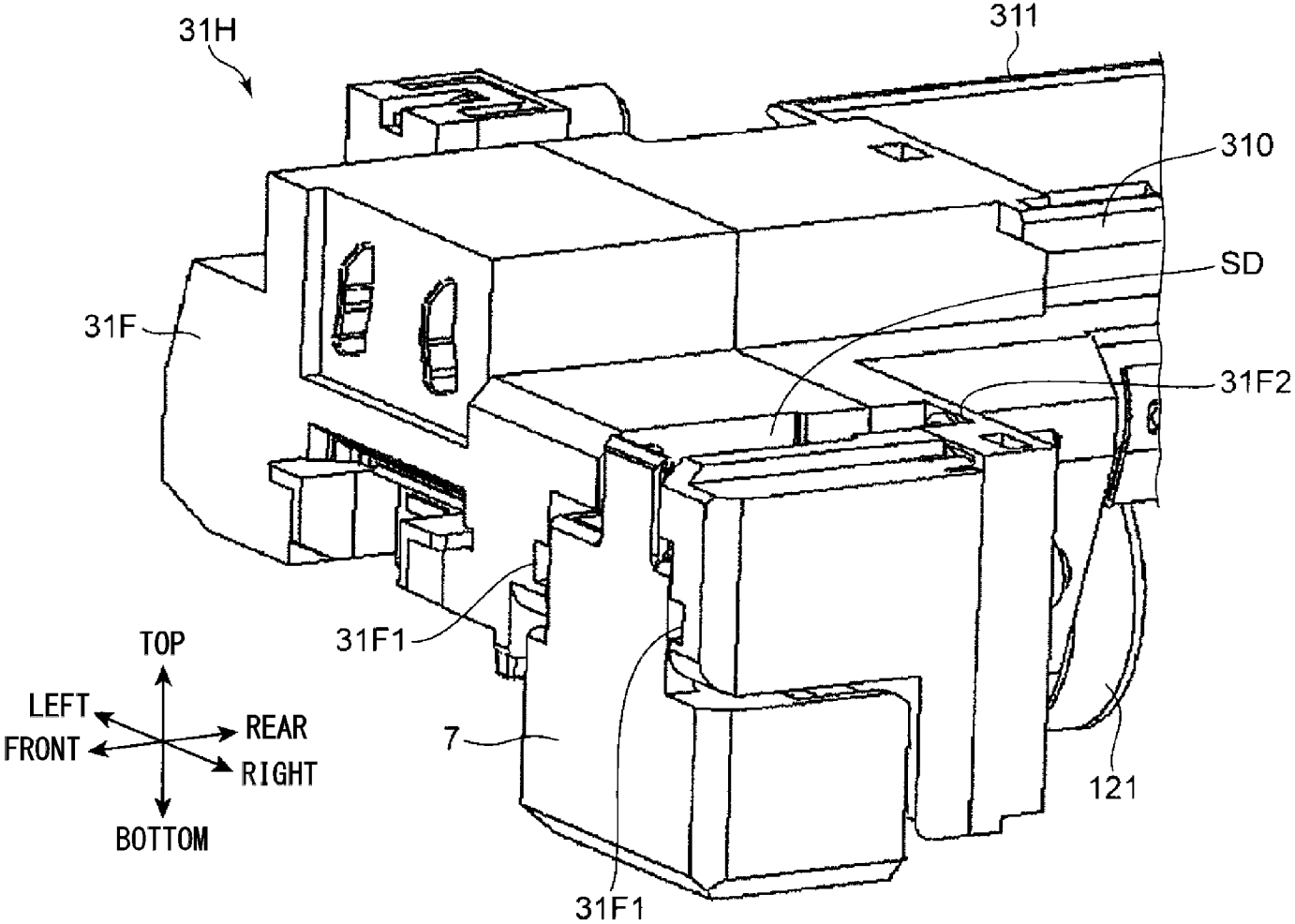
FIG. 6 is an enlarged perspective view showing the drum unit according to the embodiment of the disclosure.
Figure 7:
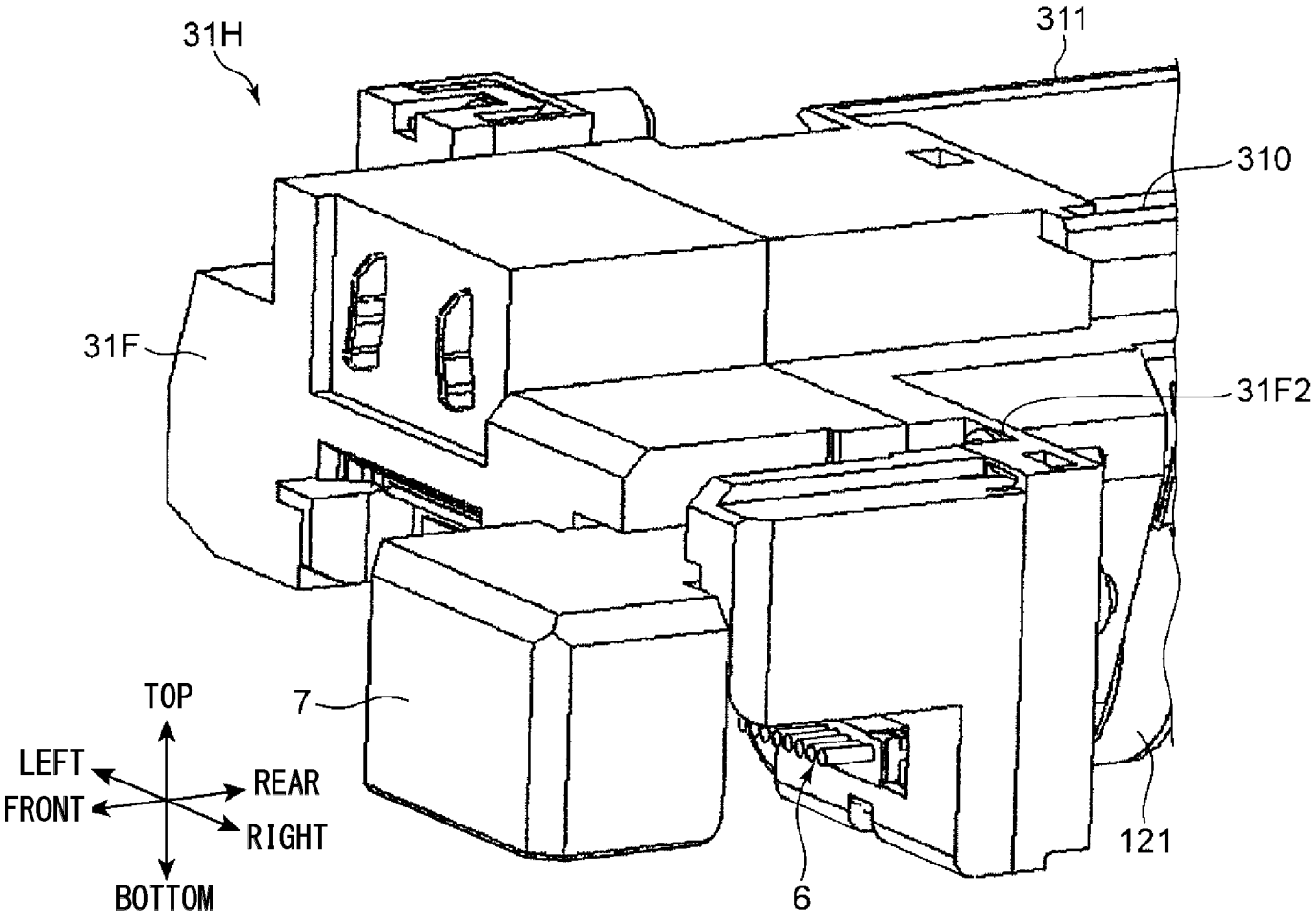
FIG. 7 is another enlarged perspective view showing the drum unit according to the embodiment of the disclosure.
Figure 8:
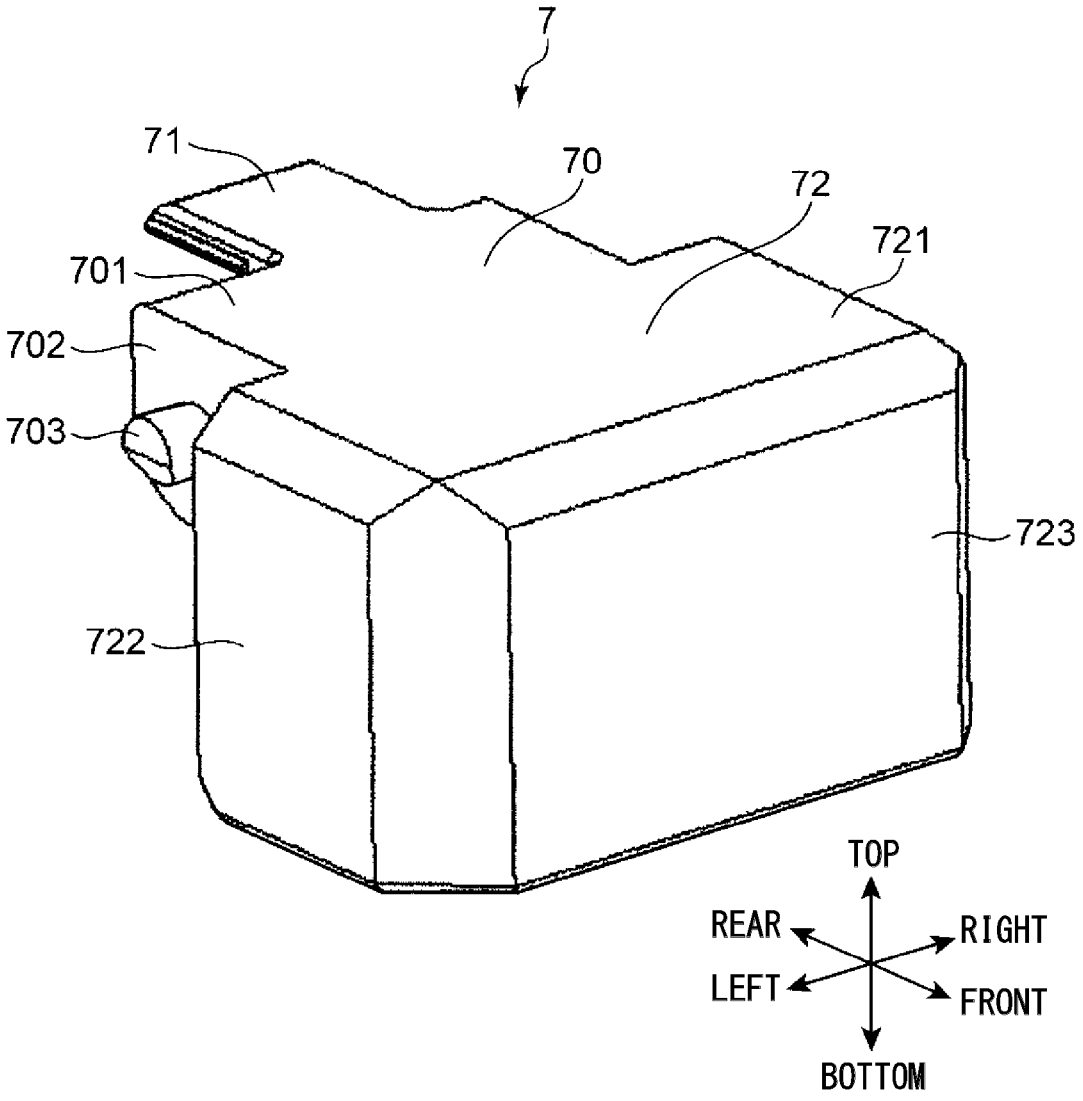
FIG. 8 is a perspective view showing a connector cover according to the embodiment of the disclosure.
Figure 9:
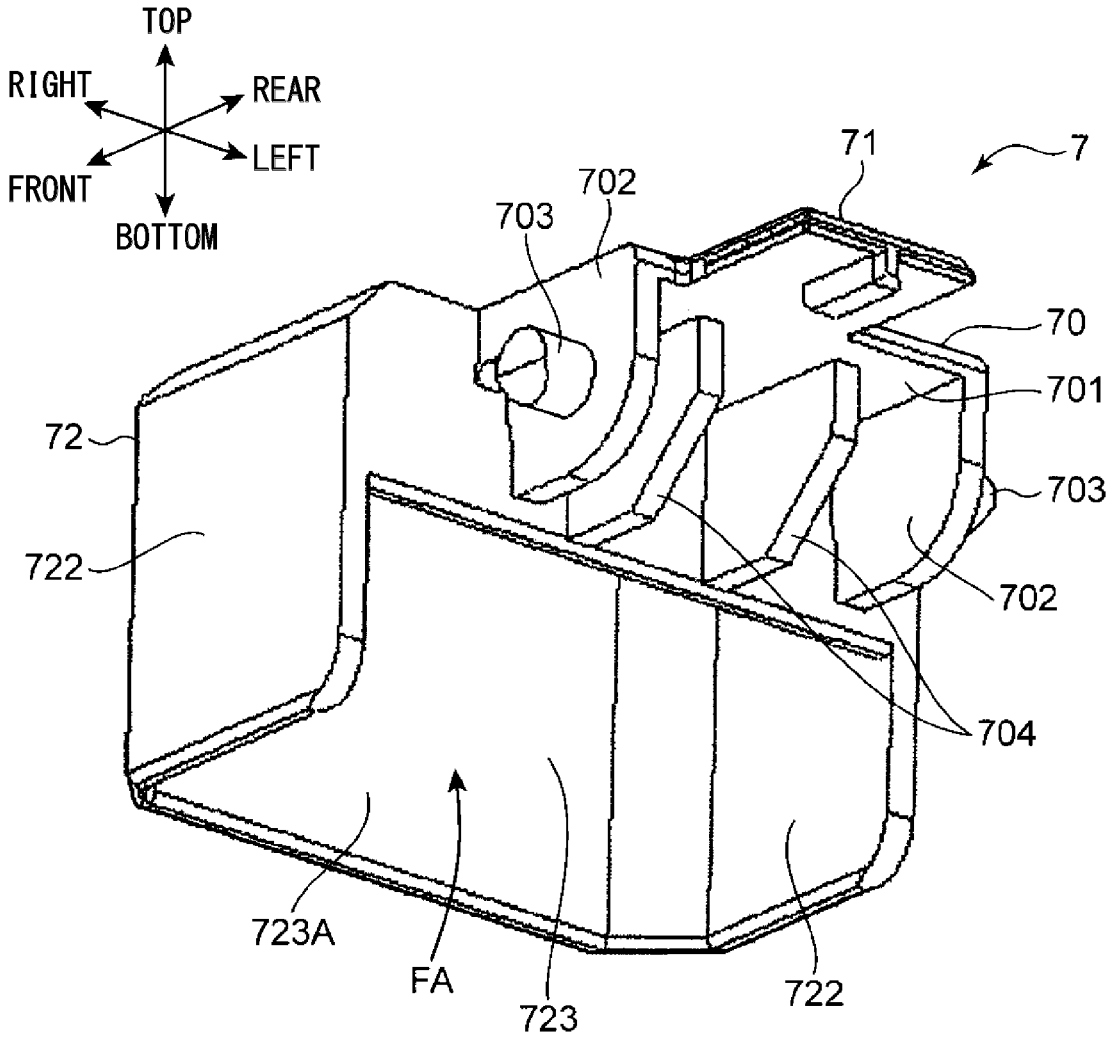
FIG. 9 is another perspective view showing the connector cover according to the embodiment of the disclosure.

Referring now to FIGS. 4 through 9, a configuration of the drum unit 31H (support unit) according to this embodiment will be described. FIGS. 4 and 5 are perspective views showing the drum unit 31H according to this embodiment, and FIGS. 6 and 7 are enlarged perspective views showing a forward portion of the drum unit 31H. FIGS. 8 and 9 are perspective views of a connector cover 7 (described later) attached to the drum unit 31H. Here, FIGS. 4 and 6 illustrate a closed position (second position) of the connector cover 7, while FIGS. 5 and 7 illustrate an open position (first position) of the connector cover 7. The drum unit 31H is mounted in the lower casing 21 having the internal space S. The drum unit 31H is inserted toward the internal space S in the direction indicated by the arrow D21 in FIG. 2 (insertion direction), and then fixed inside the lower casing 21.

As already stated, the drum unit 31H includes the photoconductor drum 121 (image carrier), the charger 122, the cleaning unit 35, and the static eliminator 50 (see FIG. 3). In addition, the drum unit 31H includes a front wall 31F (wall portion) and a rear wall 31R on the respective end portions in the front-back direction. The front wall 31F and the rear wall 31R constitute a pair of wall portions opposing each other via the drum unit 31H in the front-back direction. In particular, the front wall 31F is erected on the upstream end portion of the drum unit 31H in the insertion direction. The front wall 31F and the rear wall 31R are spaced from each other in the front-back direction by a predetermined distance. The front wall 31F and the rear wall 31R serve to rotatably support the photoconductor drum 121. The front wall 31F and the rear wall 31R also serve to support the charger 122, the cleaning unit 35, and the static eliminator 50, so as to oppose the photoconductor drum 121.

The photoconductor drum 121 includes a rotary shaft 121A and a cylindrical surface 121B set to rotate about the rotary shaft 121A. On the cylindrical surface 121B the static latent image is formed, and the toner image corresponding to the static latent image is retained. To form the photoconductor drum 121, amorphous silicon (a-Si) based material may be employed.

The drum unit 31H also includes a right insertion lug 310 and a left insertion lug 311. The right insertion lug 310 and the left insertion lug 311 are plate-shaped members extending between the front wall 31F and the rear wall 31R, along the upper end portion of the drum unit 31H. The right insertion lug 310 and the left insertion lug 311 are spaced from each other in the left-right direction. The right insertion lug 310 is formed so as to protrude to the right, in a cross-sectional view intersecting the rotary shaft 121A of the photoconductor drum 121. Likewise, the left insertion lug 311 is formed so as to protrude to the left. The right insertion lug 310 and the left insertion lug 311 serve as a guide for the drum unit 31H to be mounted in the lower casing 21.

The front wall 31F includes a bearing portion 31F1 and a screw hole 31F2 (see FIG. 6).

The bearing portion 31F1 is constituted of a pair of bearing cavities opposing each other in the left-right direction with a spacing therebetween, both located in the right-side portion of the front wall 31F. A shaft portion 703 (described later) of the connector cover 7 is inserted in the bearing portion 31F1.

The screw hole 31F2 has its opening on the front wall 31F. The screw hole 31F2 is located close to the rear end portion of the right-side portion of the front wall 31F. A predetermined screw is inserted in the screw hole 31F2 when the drum unit 31H is mounted in the lower casing 21. The screw inserted in the screw hole 31F2 is screw-fitted to a fastening position 203 (described later) of the lower casing 21, so that the drum unit 31H is fixed to the lower casing 21. In a region of the front wall 31F forward of the screw hole 31F2 (upstream side in the insertion direction), a forward space SD (second space) is defined. The forward space SD is a hollow portion formed by cutting away a portion of the front wall 31F forward of the screw hole 31F2 along the insertion direction.

The drum unit 31H further includes a connector 6 (connector unit) and the connector cover 7 (cover member).

The connector 6 is located in the right lower portion of the front wall 31F. The connector 6 is oriented to the upstream side (front side) in the insertion direction, on the front wall 31F. The connector 6 includes a plurality of pin terminals aligned in the left-right direction. The pin terminals stick out in the forward direction. When the drum unit 31H is mounted in the lower casing 21, a non-illustrated electrical connector extending from the lower casing 21 is connected to the connector 6. Accordingly, driving power and control signals are supplied from the lower casing 21 to the drum unit 31H, through the connector 6.

The connector cover 7 is located in the right-side portion of the front wall 31F, and forward of the screw hole 31F2 and the connector 6. The connector cover 7 is pivotably supported by the front wall 31F of the drum unit 31H. In a first phase in which the drum unit 31H is to be inserted in the internal space S, the connector cover 7 is set to the first position to be grasped for inserting the drum unit 31H. In contrast, in a second phase in which the drum unit 31H is mounted in the lower casing 21, the connector cover 7 made to pivot to the second position so as to protect the connector 6. The connector cover 7 includes a support portion 70, a screw cover 71, and a connector protecting portion 72. Hereafter, a configuration of the connector cover 7 will be described with reference to the connector cover 7 in the first position shown in FIGS. 8 and 9.

The support portion 70 is located in the central portion of the connector cover 7 in the front-back direction. The support portion 70 includes a support wall 701, a pair of side walls 702, a pair of shaft portions 703, and a pair of ribs 704 (see FIG. 9). The support wall 701 is oriented in the vertical direction in the first position. The side walls 702 are formed so as to extend from the respective end portions of the support wall 701 in the left-right direction. The shaft portions 703 respectively stick out in the left-right direction from the side walls 702. The shaft portions 703 serve as the shaft about which the connector cover 7 is made to pivot. The ribs 704 are formed under the support wall 701 parallel to the side walls 702, and serve to increase the rigidity of the connector cover 7.

The screw cover 71 (third wall portion) is formed so as to extend backward from the support portion 70. The screw cover 71 is a plate-shaped member extending backward from the central portion of the support wall 701 of the support portion 70 in the left-right direction. The screw cover 71 serves to conceal the screw hole 31F2 of the front wall 31F.

The connector protecting portion 72 is formed so as to extend forward from the support portion 70, and serves to protect the connector 6. The connector protecting portion 72 includes a protection wall 721 (second wall portion), a pair of side walls 722, and a bottom wall 723 (first wall portion). The protection wall 721 is formed so as to extend forward from the support wall 701 of the support portion 70. The protection wall 721 is slightly wider than the support wall 701 in the left-right direction. The protection wall 721 is the primary portion that protects the connector 6. The side walls 722 extend from the respective end portions of the protection wall 721 in the left-right direction. The bottom wall 723 extends from the front edge of the protection wall 721 so as to intersect the protection wall 721. The bottom wall 723 is also connected to the front edge of the pair of side walls 722. The bottom wall 723 is the portion to be grasped by the operator when the drum unit 31H is to be inserted in the internal space S. Here, the screw cover 71 is located opposite (on the rear side of) the protection wall 721 of the connector protecting portion 72, with respect to the shaft portion 703.

Further, as shown in FIGS. 8 and 9, in the first position of the connector cover 7 the protection wall 721 is disposed so as to extend to the downstream side in the insertion direction, from the upper end portion of the bottom wall 723. When the connector cover 7 is made to pivot to the first position in the first phase, a grasping space FA (first space) is formed under the protection wall 721 and downstream of the bottom wall 723 in the insertion direction, and having an opening oriented downward. The operator can insert the fingers in the grasping space FA so as to hold the first wall portion 723, when inserting the drum unit 31H in the internal space S.

Figure 10:
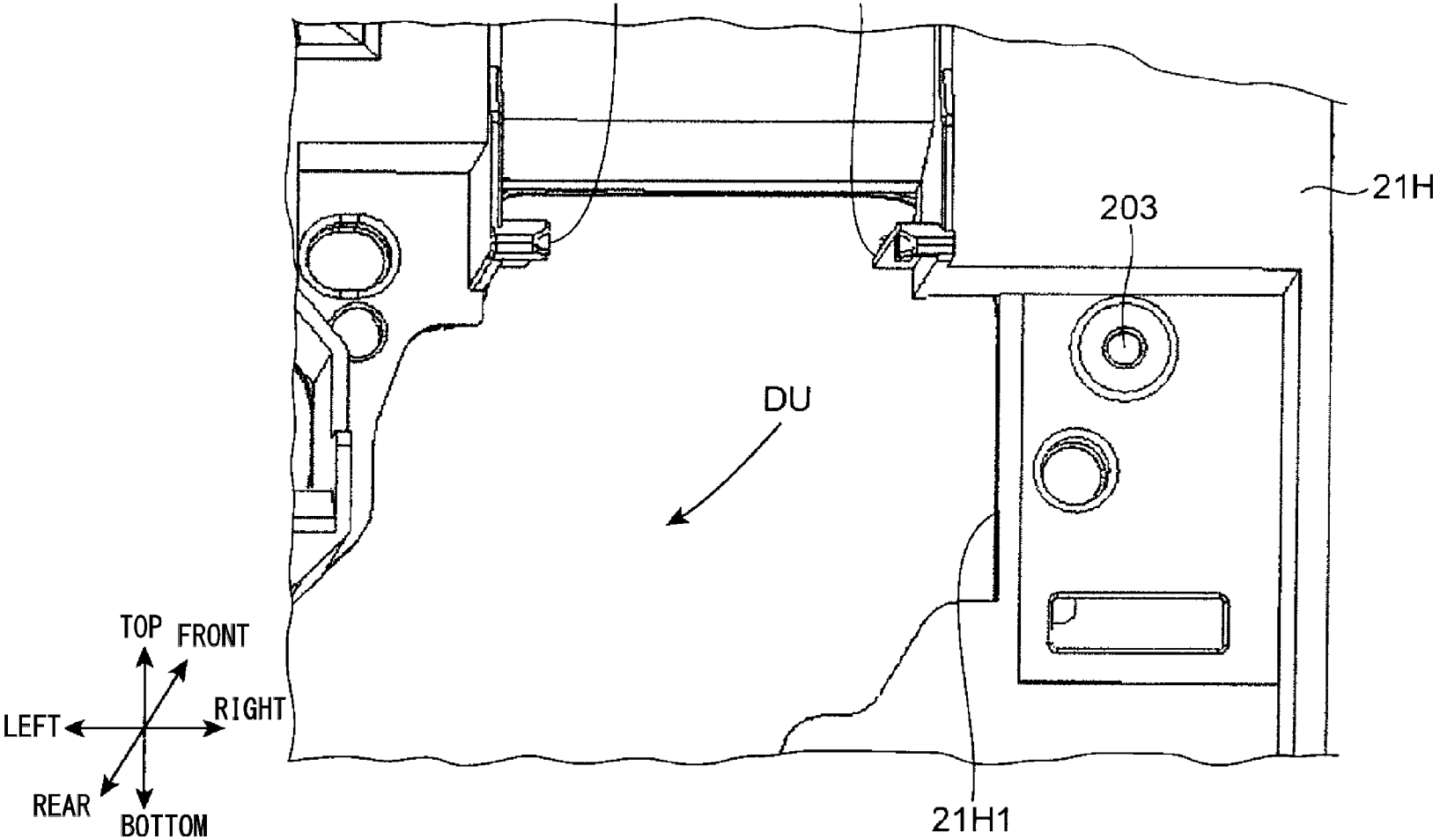
FIG. 10 is a perspective view showing a space in which the drum unit according to the embodiment of the disclosure is inserted.
Figure 11:
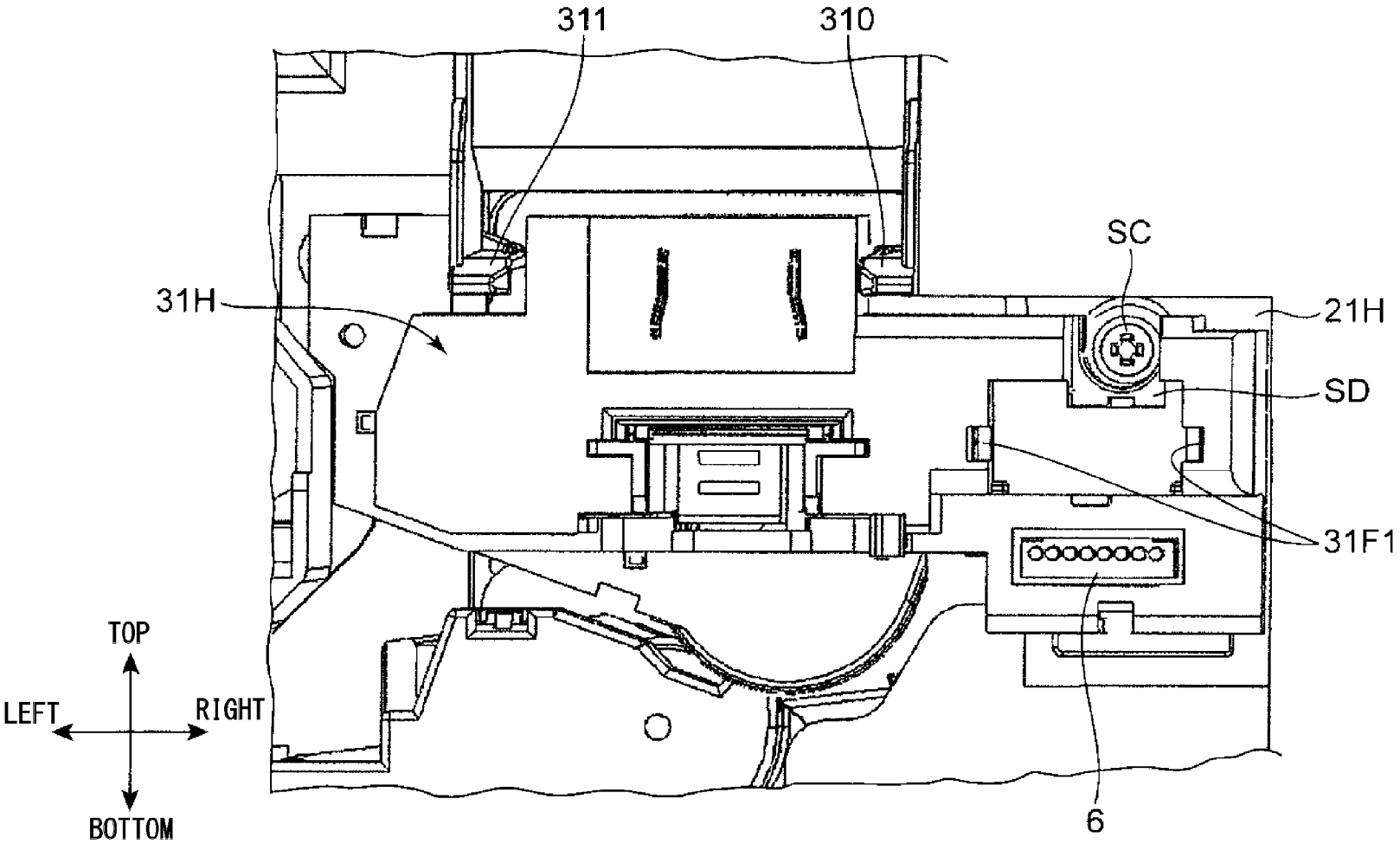
FIG. 11 is a front view showing a state in which the drum unit is mounted in the insertion space, with the cover member excluded.
Figure 12:
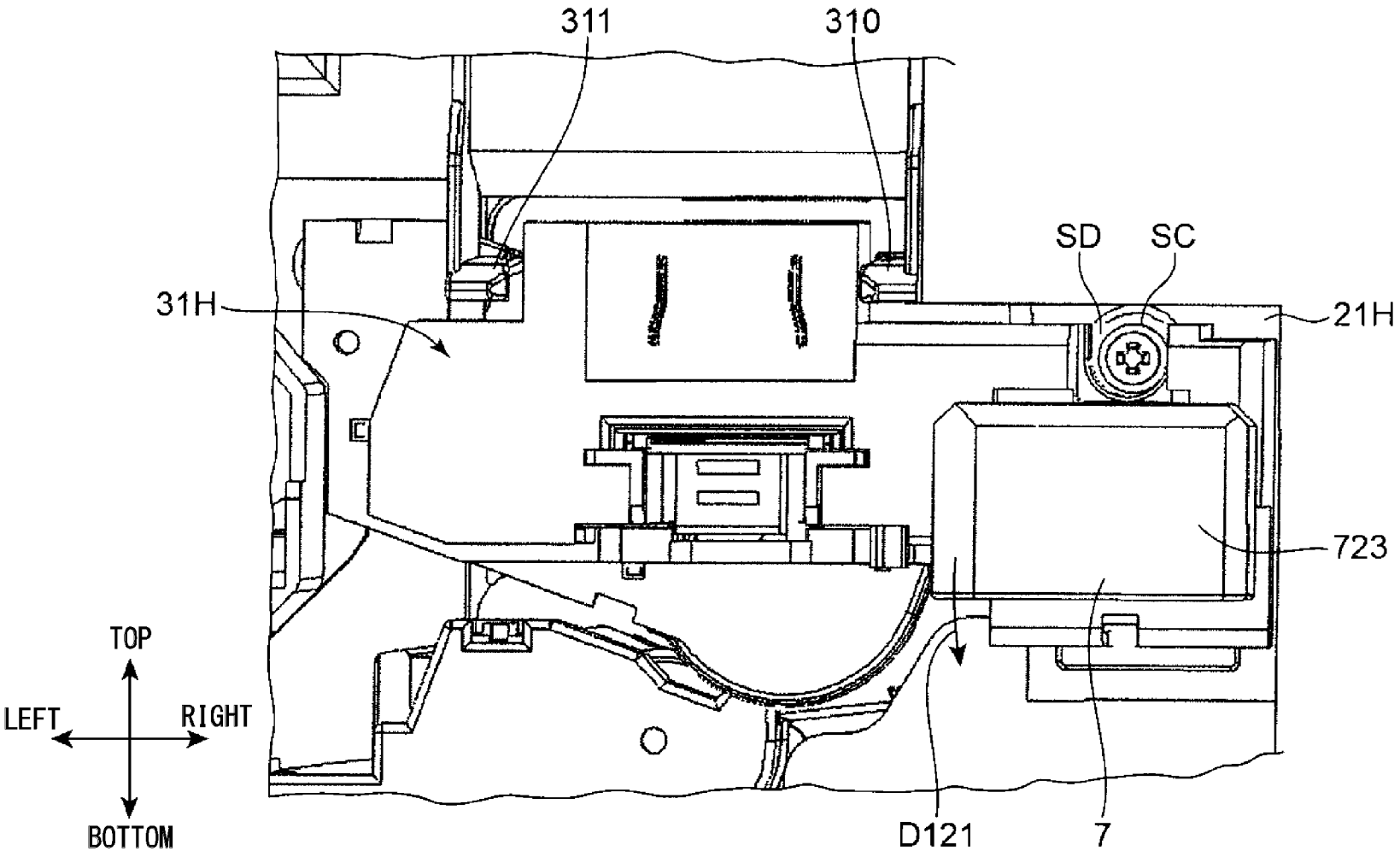
FIG. 12 is a front view of the image forming apparatus in which the drum unit is mounted in the insertion space and the cover member is located at a first position.
Figure 13:
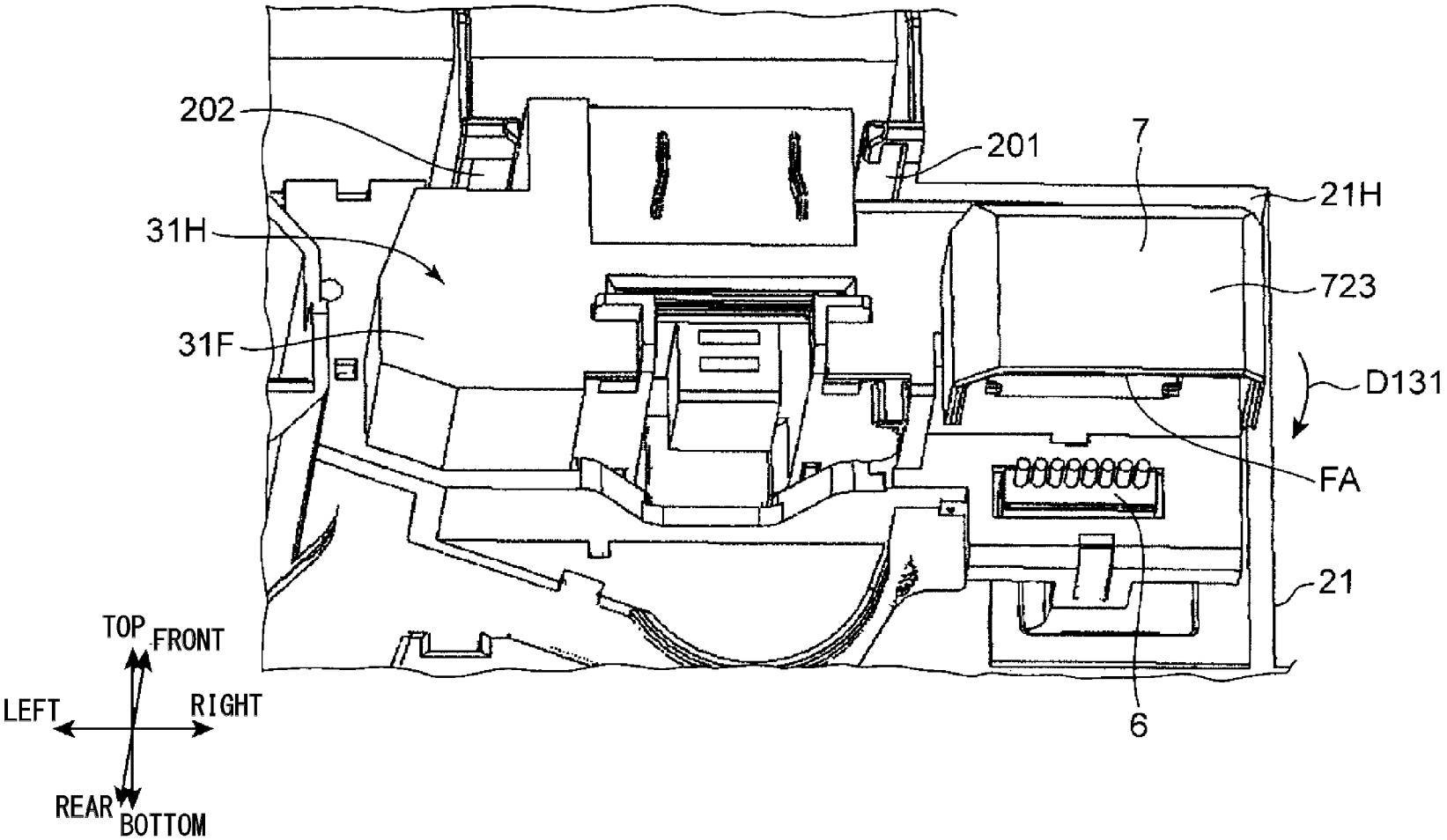
FIG. 13 is a perspective view of the image forming apparatus in which the drum unit is mounted in the insertion space and the cover member is located at the first position.
Figure 14:
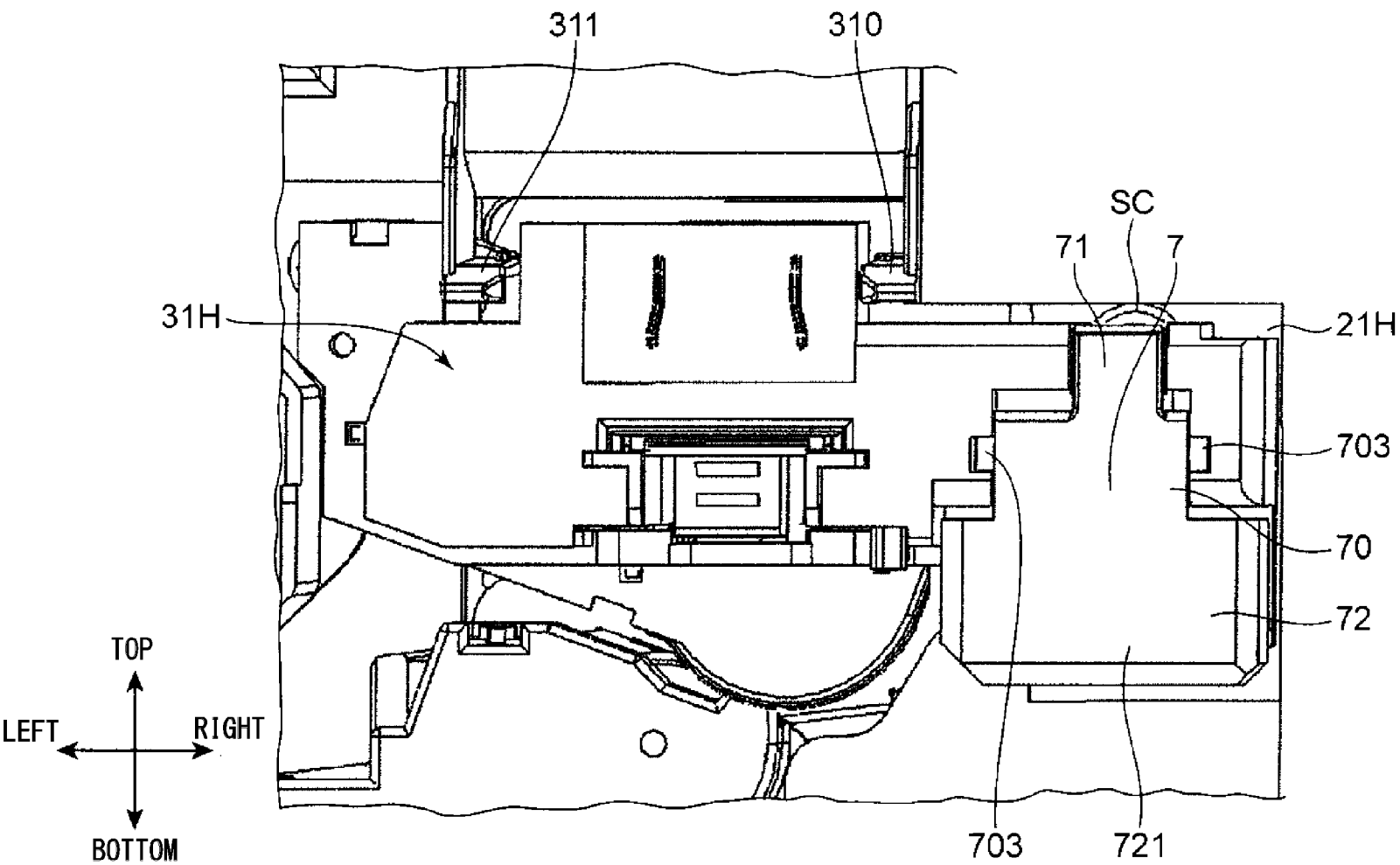
FIG. 14 is a front view of the image forming apparatus in which the drum unit is mounted in the insertion space and the cover member is located at a second position.

Referring now to FIGS. 10 through 14 in addition to FIGS. 4 through 9, the process for mounting the drum unit 31H in the internal space S of the lower casing 21 will be described in details. FIG. 10 is a perspective view showing an insertion space DU in the lower casing 21, in which the drum unit 31H is inserted. FIG. 11 is a front view of the lower casing 21 in which the drum unit 31H is mounted and the connector cover 7 is excluded for the sake of clarity. FIGS. 12 and 13 are a front view and a perspective view respectively, showing the lower casing 21 in which the drum unit 31H is mounted and the connector cover 7 is open (first position). FIG. 14 is a front view of the lower casing 21 in which the drum unit is mounted and the cover member is closed (second position).

As shown in FIG. 10, the lower casing 21 includes a front wall 21H. The front wall 21H constitutes the frontal portion of the lower casing 21, and is erected on the inner side of the right cover 21B. The front wall 21H includes an opening 21H1 of a generally rectangular shape and formed on the right-side portion of the front wall 21H. The opening 21H1 allows communication between outside of the lower casing 21 and the internal space S (see FIG. 3). The insertion space DU extends from the opening 21H1 toward the internal space S. The insertion space DU is provided for the drum unit 31H to be inserted into the lower casing 21.

The lower casing 21 includes a right rail portion 201 and a left rail portion 202. The right rail portion 201 and the left rail portion 202 are fixed to the front wall 21H at an upper position of the insertion space DU. The right rail portion 201 and the left rail portion 202 stick out into the insertion space DU to the left and to the right, respectively. The right insertion lug 310 and the left insertion lug 311 of the drum unit 31H are respectively engaged with the right rail portion 201 and the left rail portion 202.

The operator sets the connector cover 7 to the first position shown in FIGS. 5 and 7, to insert the drum unit 31H into the insertion space DU. At this point, the bottom wall 723 of the connector cover 7 is oriented so as to intersect the insertion direction. In other words, the bottom wall 723 is oriented upright so as to intersect the front-back direction. In contrast, the protection wall 721 of the connector cover 7 is oriented along the insertion direction. To be more detailed, the protection wall 721 extends in the front-back direction so as to intersect the up-down direction. The screw cover 71 extending backward from the protection wall 721 is also oriented along the insertion direction. To be more detailed, the screw cover 71 extends in the front-back direction so as to intersect the up-down direction.

The operator can insert the fingers in the grasping space FA formed inside the connector cover 7 to touch a grasping surface 723A of the bottom wall 723. Accordingly, the operator can insert the drum unit 31H into the insertion space DU by grasping the bottom wall 723 of the connector cover 7. The operator can thus insert the drum unit 31H into the insertion space DU quite easily, and the work efficiency for mounting the drum unit 31H can be significantly improved.

In the first phase, in which the drum unit 31H is about to be inserted into the lower casing 21, the operator can grasp the bottom wall 723 and easily insert the drum unit 31H into the lower casing 21, by simply pivoting the connector cover 7 about the shaft portion 703 to set the connector cover 7 to the first position.

When the drum unit 31H is inserted as far as the rear end portion of the insertion space DU, the screw hole 31F2 in the front wall 31F of the drum unit 31H is opposed to the fastening position 203 (see FIG. 10) of the front wall 21H. At this point, a frontal portion of the forward space SD is open. Therefore, the operator can insert a tool such as a screw driver into the forward space SD, so as to insert a screw SC into the screw hole 31F2 and fasten the screw SC to the fastening position 203. The drum unit 31H can thus be fixed to the lower casing 21.

In the state described above, as shown in FIG. 12, the screw SC is exposed in the front face of the image forming apparatus 1. In addition, as shown in FIG. 13, the connector 6 is exposed in the front face of the image forming apparatus 1, when viewed from slightly below the connector cover 7. Accordingly, the screw SC and the connector 6 are accessible by the user of the image forming apparatus 1 when the user removes the right cover 21B (see FIGS. 1 and 2). Therefore, the screw SC or the connector 6 may be accidentally removed.

According to this embodiment, however, the connector cover 7 can be made to pivot by the operator after the drum unit 31H is mounted in the lower casing 21. More specifically, in the second phase in which the drum unit 31H is mounted in the lower casing 21, the connector cover 7 is made to pivot about the shaft portion 703 as indicated by arrows D121 in FIG. 12 and D131 in FIG. 13. As a result, the connector cover 7 is set to the second position shown in FIG. 14. At this point, the bottom wall 723 of the connector cover 7 is oriented so as to extend in the insertion direction. To be more detailed, the bottom wall 723 extends in the front-back direction so as to intersect the up-down direction. In contrast, the protection wall 721 of the connector cover 7 is vertically oriented (so as to intersect the insertion direction) forward of the connector 6 (upstream side in the insertion direction). Accordingly, the region forward of the connector 6 is blocked by the protection wall 721 and the connector 6 can be effectively protected. In addition, the bottom wall 723 that has been made to pivot covers the region under the connector 6, and therefore the lower portion of the connector 6 shown in FIG. 13 is effectively protected by the bottom wall 723. Further, connector 6 can be made unseen by the user of the image forming apparatus 1.

When the operator intends to remove the drum unit 31H from the lower casing 21, the connector cover 7 is again made to pivot to the first position shown in FIG. 12, so that the forward space SD is opened and the screw SC becomes accessible. Then the operator can draw out (remove) the drum unit 31H from the insertion space DU by grasping the bottom wall 723 of the connector cover 7.

Thus, the configuration described above allows the drum unit 31H to be easily mounted in the image forming apparatus 1 and assures the electrical connection between the image forming apparatus 1 and the drum unit 31H.

In addition, when the drum unit 31H is in the second phase, the connector 6 is protected and also the region upstream of the screw hole 31F2 in the insertion direction is covered with the screw cover 71. Therefore, access to the screw SC can be effectively prevented in the second phase. In particular, the screw hole 31F2 can be prevented from being seen by persons other than the relevant operator while the drum unit 31H is set in the lower casing 21.

When the drum unit 31H is in the first phase, the grasping space FA is formed inside the connector cover 7, under the protection wall 721 and downstream of the bottom wall 723 in the insertion direction. The grasping space FA is open downward. Such a configuration allows the operator to insert the fingers in the grasping space FA when the drum unit 31H is mounted in the apparatus main body, thereby further improving the work efficiency in mounting the drum unit 31H.

When the drum unit 31H is in the second phase, the connector cover 7 is made to pivot so that the upstream portion of the forward space SD in the insertion direction is covered with the screw cover 71. Therefore, the screw hole 31F2 can be prevented from being seen by persons other than the relevant operator, while the drum unit 31H is set in the lower casing 21. In contrast, in the first phase the operator can insert a tool such as a screw driver into the forward space SD so as to access the screw hole 31F2. Therefore, the screw hole 31F2 can be easily accessed even when the screw hole 31F2 is located at a deep position of the wall portion.

Although the image forming apparatus according to the embodiment of the disclosure has been described as above, it is to be understood that the disclosure is in no way limited to the foregoing embodiment but may be modified as exemplified hereunder.

In the foregoing embodiment, the support unit that includes the connector cover 7 is described with reference to the drum unit 31H, however the support unit may be realized in different manners. For example, the disclosure may be applied to a developer unit that supports the developing device 124. In this case, work efficiency for mounting the support unit that supports the developing device can be improved, and the connector unit can be effectively protected. Alternatively, the disclosure may be applied to a support unit that supports a predetermined member or device, configured to be removably mounted in the main casing 2 of the image forming apparatus 1.

For example, conventional support units for drum unit include a grasp portion for mounting and removal and a cover member that protects the connector unit, which are formed separately. Such a configuration leads to an increase in number of parts composing the support unit and complication of the structure of the support unit, as well as to an increase in manufacturing cost. In addition, the support unit may be mounted in the apparatus main body with the connector unit left uncovered with the cover member. In this case, the user may accidentally draw out the connector unit upon opening the cover of the apparatus main body. However, the drum unit 31H according to the foregoing embodiment eliminates such drawbacks.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A support unit configured to support a member to be supported and be inserted in an apparatus main body thus to be mounted therein, the support unit comprising:

a wall portion provided on an upstream end portion of the support unit in the direction in which the support unit is inserted;

a connector unit provided on the wall portion for electrical connection between the apparatus main body and the support unit; and a cover member pivotably supported by a bearing portion provided on the wall portion, so as to pivot between a first position in which the connector unit is exposed so as to allow an operator to grasp the cover member, and a second position in which the connector unit is concealed, wherein the cover member includes a second wall portion extending in a direction intersecting the insertion direction in the second position, and a first wall portion extending from the second wall portion in the insertion direction so as to intersect the second wall portion, and in the first position, the second wall portion extends in the insertion direction, and the first wall portion is located upstream of the position where the first wall portion is located when the cover member is in the second position, and extends in the direction intersecting the insertion direction.

2. The support unit according to claim 1, wherein the wall portion includes a screw hole for a screw to be inserted, formed at a position deviated from an end portion of the second wall portion of the cover member in the second position, the wall portion includes a third wall portion formed at the end portion of the second wall portion of the cover member in the second position and extending in the insertion direction so as to cover the screw hole, and the third wall portion is disposed so as to extend in the insertion direction together with the second wall portion when the cover member is in the first position, and so as to extend in the direction intersecting the insertion direction together with the second wall portion when the cover member is in the first position.

3. The support unit according to claim 2, wherein the wall portion includes a second space extending in the insertion direction and located upstream of the screw hole in the insertion direction, and the third wall portion is disposed to extend in the insertion direction so as to open the second space when the cover member is in the first position, and disposed to cover the second space so as to oppose the screw hole in the insertion direction, when the cover member is in the second position.

4. The support unit according to claim 1, wherein a first space is formed in the cover member when the cover member is at the first position, the first space being located downstream of the first wall portion in the insertion direction and surrounded by the second wall portion and the first wall portion extending from the second wall portion.

5. The support unit according to claim 1, configured to support an image carrier that retains an image as the member to be supported.

6. An image forming apparatus, comprising:

the apparatus main body;

an image forming unit located inside the apparatus main body and configured to form an image on a recording medium; and the image forming apparatus including the support unit according to claim 1.

* * * * *